US006539194B2

(12) United States Patent
Oikawa

(10) Patent No.: US 6,539,194 B2
(45) Date of Patent: Mar. 25, 2003

(54) IMAGE FORMING APPARATUS INCLUDING TRANSFER BELT HAVING FIRST AND SECOND IMAGE TRANSFER SURFACE PLANES ARRANGED AT AN ANGLE, AND PLURAL IMAGE BEARING MEMBERS FACING SAME

(75) Inventor: Atsuteru Oikawa, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/976,092

(22) Filed: Oct. 15, 2001

(65) Prior Publication Data

US 2002/0057931 A1 May 16, 2002

(30) Foreign Application Priority Data

Nov. 13, 2000 (JP) ..... 2000-345086
Sep. 4, 2001 (JP) ..... 2001-266833

(51) Int. Cl.[7] ..... G03G 15/01
(52) U.S. Cl. ..... 399/299; 399/302; 399/303
(58) Field of Search ..... 399/107, 297, 399/298, 299, 300, 301, 302, 303, 306, 307, 308, 312, 313; 347/116

(56) References Cited

U.S. PATENT DOCUMENTS 5,075,730 A * 12/1991 Hoshi ..... 399/302
5,313,259 A * 5/1994 Smith ..... 399/299 X
5,999,201 A * 12/1999 Dalal et al. ..... 399/302 X
6,175,702 B1 * 1/2001 Takeuchi et al. ..... 399/297 X
6,097,922 A1 * 8/2001 Munenaka ..... 399/312
6,389,260 B1 * 5/2002 Kataoka et al. ..... 399/298

FOREIGN PATENT DOCUMENTS

JP 5-72867 3/1993

* cited by examiner

*Primary Examiner*—Sandra Brase
(74) *Attorney, Agent, or Firm*—Fitzpatrick, Cella, Harper & Scinto

(57) ABSTRACT

An image forming apparatus includes a plurality of image bearing members, each for bearing an image, a transfer belt onto which images on each of the image bearing members are transferred, and a transfer device for transferring an image on the transfer belt onto a transfer material. When images borne on the plurality of image bearing members are sequentially transferred onto the transfer belt so as to form superposed images, such superposed images simultaneously are transferred onto the transfer material. An angle made by a first surface plane of the transfer belt which at least one of the plurality of image bearing members faces and a second surface plane of the transfer belt which image bearing members other than the at least one image bearing member face is substantially a right angle.

40 Claims, 7 Drawing Sheets

IMAGE FORMING APPARATUS INCLUDING TRANSFER BELT HAVING FIRST AND SECOND IMAGE TRANSFER SURFACE PLANES ARRANGED AT AN ANGLE, AND PLURAL IMAGE BEARING MEMBERS FACING SAME

BACKGROUND OF THE INVENTION

1. Field of the Invention

The present invention relates to an image forming apparatus which uses an electrostatic image recording method, an electrophotographic image recording method or the like. More particularly, the invention relates to an image forming apparatus which includes a plurality of image forming means, and performs image formation using an intermediate transfer member or a transfer-material bearing member.

2. Description of the Related Art

FIG. 7 is a cross-sectional view illustrating a principal portion of a conventional image forming apparatus.

An image forming apparatus 1P includes an image forming unit 10 including laterally arranged stations a, b, c and d each having substantially the same configuration, a feeding unit 20, an intermediate transfer unit 30, a fixing unit 40, and a control unit (not shown).

The respective units will now be described in detail.

The image forming unit 10 includes photosensitive drums 11*a*, 11*b*, 11*c* and 11*d*, each serving as an image bearing member. Each of the photosensitive drums 11*a*–11*d* is supported for rotation around its axis, and is rotatably driven in the direction of an arrow. Primary chargers 12*a*, 12*b*, 12*c* and 12*d*, optical systems 13*a*, 13*b*, 13*c* and 13*d*, and developing units 14*a*, 14*b*, 14*c* and 14*d* are disposed around the outer circumferences of the photosensitive drums, 11*a*, 11*b*, 11*c* and 11*d* in the direction of rotation, respectively. The primary chargers 12*a*–12*d* provide a uniform amount of charges on the surfaces of the photosensitive drums 11*a*–11*d*, respectively. The optical systems 13*a*–13*d* form electrostatic latent images on the photosensitive drums 11*a*–11*d* by exposing the photosensitive drums 11*a*–11*d*, respectively, using a light beam, such as a laser beam or the like, modulated in accordance with a recording image signal. Then, the electrostatic latent images are developed by the developing units 14*a*–14*d* which accommodate developers (toners) having four colors, i.e., yellow, cyan magenta and black, respectively. Cleaning devices 15*a*, 15*b*, 15*c* and 15*d* are disposed at portions downstream from image primary transfer regions Ta, Tb, Tc and Td for transferring the developed images onto an intermediate transfer member (an intermediate transfer belt 31, to be described later), respectively. Toner particles remaining on the photosensitive drums 11*a*–11*d* (those not transferred onto the intermediate transfer member 31) are scraped off by the cleaning devices 15*a*–15*d*, to clean the surfaces of the photosensitive drums 11*a*–11*d*, respectively.

According to the above-described process, image formation by the toners having the respective colors is performed.

The feeding unit 20 includes a cassette 21*a* and a manual feed tray 27 for accommodating sheets of a recording material P, pickup rollers 22 and 26 for individually feeding sheets of the recording material P from the cassette 21*a* and the manual feed tray 27, respectively, pairs of rollers 23 and a feeding guide 24 for feeding a sheet of the recording material P fed from the corresponding one of the pickup rollers 22 and 26 to registration rollers 25*a* and 25*b*, and the registration rollers 25*a* and 25*b* for conveying the sheet of the recording material P to a secondary transfer region in synchronization with the timing of image formation by the image forming unit 10.

The intermediate transfer unit 30 includes an intermediate transfer belt 31 made of PET (polyethylene terephthalate), PVdF (polyvinylidene fluoride) or the like. The intermediate transfer belt 31 moves around a driving roller 32 for transmitting a driving force to the intermediate transfer belt 31, a tension roller 33 for providing the intermediate transfer belt 31 with an appropriate tension by urging it by means of a spring or the like, and a driven roller 34 facing a secondary transfer region Te via the intermediate transfer belt 31. A primary transfer plane A is formed between the tension roller 33 and the driving roller 32. The driving roller 32 comprises a metal roller having a urethane-rubber or chloroprene-rubber coating a few mm thick on a surface thereof, in order to prevent slip relative to the intermediate transfer belt 31. The driving roller 32 is rotatably driven by a pulse motor (not shown). Primary transfer devices 35*a*–35*d* are provided at the primary transfer regions Ta–Td where the photosensitive drums 11*a*–11*d* face the intermediate transfer belt 31, respectively, at positions behind the intermediate transfer belt 31. A secondary transfer device 36 is provided at a secondary transfer region Te where the driven roller 34 faces the intermediate transfer belt 31, so as to face the driven roller 34 via the intermediate transfer belt 31. A cleaning device 50 for cleaning the image forming surface of the intermediate transfer belt 31 is provided on the image transfer belt 31 at a portion downstream from the secondary transfer region Te. The cleaning device 50 includes a cleaner blade 51 made of polyurethane rubber or the like, and a waste-toner box 52 for accommodating waste toner.

The fixing unit 40 includes a fixing roller 41*a* incorporating a heat source, such as a halogen-lamp heater or the like, a roller 41*b* pressed against the fixing roller 41*a*, a guide 43 for guiding the sheet of the recording material P to a nip portion constituted by a pair of the rollers 41*a* and 41*b*, internal discharging rollers 44 for guiding the sheet of the recording material P discharged from the nip portion further to the outside of the apparatus, and external discharging rollers 45. Reference numeral 46 represents a casing.

Next, the operation of the above-described image forming apparatus will now be described.

When an image-forming-operation start signal is provided, sheets of the recording material P are individually fed from the cassette 21*a* by the pickup roller 22. A sheet of the recording material P thus fed is conveyed to the registration rollers 25*a* and 25*b* after passing through the feeding guide 24 by the pair of feeding rollers 23. At that time, the registration rollers 25*a* and 25*b* are stopped, and the leading edge of the sheet of the recording material P contacts the nip portion. Thereafter, the registration rollers 25*a* and 25*b* start to rotate at the timing at which the image forming unit 10 starts image formation. The start of rotation of the registration rollers 25*a* and 25*b* is set to coincide with arrival of the sheet of the recording material P and the toner image being subjected to primary transfer on the intermediate transfer belt 31 in the image forming unit 10 at the secondary transfer region Te.

In the image forming unit 10, when an image-forming-operation signal is provided, the toner image formed on the photosensitive drum 11*d* at the most upper-stream portion in the direction of rotation of the intermediate transfer belt 31 according to the above-described process is subjected to primary transfer at the primary transfer region Td by the primary transfer device 35*d* where a high voltage is applied. The toner image subjected to primary transfer is conveyed to the subsequent primary transfer region Tc. At the primary transfer region Tc, image formation is performed while being delayed by the time of conveyance of the toner image between the adjacent image forming units from the preceding image formation at the primary transfer region Td, and the subsequent toner image is transferred in a state of being adjusted to the preceding toner image. Toner images of the four colors are transferred onto the intermediate transfer belt 31 in a state of being adjusted with one another by repeating the above-described process, and the resultant four-color image subjected primary transfer proceeds to the secondary transfer region Te.

When the sheet of the recording material P enters the secondary transfer region Te in synchronization with the arrival of the four-color toner image at the secondary transfer region Te and contacts the intermediate transfer belt 31, a high voltage is applied to the secondary transfer device 36 at the timing of the passage of the sheet of the recording material P through the secondary transfer region Te, and the four-color toner image formed on the intermediate transfer belt 31 according to the above-described process is transferred onto the sheet of the recording material P. Then, the toner image is fixed on the surface of the sheet of the recording material P by the heat and the nip pressure of the pair of rollers 41*a* and 41*b*. Then, the sheet of the recording material P is conveyed by the internal discharging rollers 44 and the external discharging rollers 45 to an external discharge tray 48 of the apparatus.

In the image forming apparatus using such a conventional intermediate transfer belt, the primary transfer surfaces of the respective colors are positioned on the same plane, and the plurality of image forming units are disposed so as to correspond to the primary transfer surfaces. Furthermore, a useless space is present within a unit where the intermediate transfer belt is stretched so as to provide the primary transfer surfaces of the respective colors on the same plane.

In the image forming apparatus using the conventional intermediate transfer belt, it is difficult to reduce the size of the overall apparatus due to the configuration of the apparatus.

Japanese Patent Application Laid-Open (Kokai) No. 5-72867 (1993) discloses a configuration for reducing the size of an image forming apparatus. In this configuration, four image forming means are separated as two upper and lower means. An intermediate transfer belt facing these means is folded at an acute angle after passing through the two upper image forming means, so as to face the two lower image forming means. According to this configuration, it is possible to reduce the area required for the intermediate transfer belt compared with the configuration of laterally arranging four image forming means as shown in FIG. 4. In the configuration of Japanese Patent Application Laid-Open (Kokai) No. 5-72867 (1993), when folding the intermediate transfer belt at an acute angle, the contact area between a driving roller present at the inner surface of a folded portion of the intermediate transfer belt and the intermediate transfer belt becomes large. When the contact area is large, the offset force in the longitudinal direction of the intermediate transfer belt becomes large, thereby increasing the amount of shift of the intermediate transfer belt. In this configuration, the folded portion is present after performing transfer operations at first two image forming units. Hence, if the amount of shift of the intermediate transfer belt is large, deviation from the image transfer position by the second two image forming units after the folded portion becomes large, thereby providing large deviation between images so as to degrade the picture quality. Accordingly, compatibility of reduction in the size of the apparatus and picture quality is difficult to realize.

In the conventional apparatus, when the intermediate transfer belt and the image forming units are disposed above the fixing unit, the intermediate transfer belt and the image forming units are directly influenced by the heat of the fixing unit so as to increase the temperature within the image forming apparatus, thereby degrading the intermediate transfer belt and developers (toner) within the developing units provided in the corresponding image forming units.

When an image forming unit of a black color is disposed at the most upstream portion of the intermediate transfer belt in the moving direction, the time required for providing a first printout of a black monochromatic color, which is most frequently used, increases.

SUMMARY OF THE INVENTION

The present invention has been made in consideration of the above-described problems. It is an object of the present invention to allow reduction of the size of an image forming apparatus which uses an intermediate transfer belt or a transfer-material bearing belt, without degrading the picture quality.

According to one aspect, the present invention which achieves the above-described object relates to an image forming apparatus including a plurality of image bearing members, each for bearing an image, a transfer belt onto which an image on each of the image bearing members is transferred, and transfer means for transferring the image on the transfer belt onto a transfer material. After images on the plurality of image bearing members have been sequentially transferred onto the transfer belt in a superposed state, the superposed images simultaneously are transferred onto the transfer material. An angle made by a first surface plane of the transfer belt which at least one of the plurality of image bearing members faces and a second surface plane of the transfer belt which image bearing members other than the at least one image bearing member face is substantially a right angle.

According to another aspect, the present invention which achieves the above-described object relates to an image forming apparatus including a plurality of image bearing members, each for bearing an image, a transfer belt onto which an image on each of the image bearing members is transferred, and transfer means for transferring the image on the transfer belt onto a transfer material. After images on the plurality of image bearing members have been sequentially transferred onto the transfer belt in a superposed state, the superposed images simultaneously are transferred onto the transfer material. An angle made by a first surface plane of the transfer belt which at least one of the plurality of image bearing members faces and a second surface plane of the transfer belt which image bearing members other than the at least one image bearing member face is substantially a right angle. The apparatus also includes a belt stretching member contacting an image transfer surface region of the transfer belt other than the first surface plane and the second surface plane, for stretching the transfer belt so that a contact portion between the belt stretching member and the transfer belt approaches the first surface and the second surface.

According to still another aspect, the present invention which achieves the above-described object relates to an image forming apparatus including a plurality of image bearing members, each for bearing an image, a transfer-material bearing belt for bearing and conveying a transfer material, and transfer means for sequentially transferring respective images on the plurality of image bearing members onto the transfer material born and conveyed on the transfer-material bearing member, in a superposed state. An angle made by a first surface plane of the transfer-material bearing belt which at least one of the plurality of image bearing members faces and a second surface plane of the transfer-material bearing member which image bearing members other than the at least one image bearing member face is substantially a right angle.

According to yet another aspect, the present invention which achieves the above-described object relates to an image forming apparatus including a plurality of image bearing members, each for bearing an image, a transfer-material bearing belt for bearing and conveying a transfer material, and transfer means for sequentially transferring respective images on the plurality of image bearing members onto the transfer material born and conveyed on the transfer-material bearing member in a superposed state. An angle made by a first surface plane of the transfer-material bearing belt which at least one of the plurality of image bearing members faces and a second surface plane of the transfer-material bearing member which image bearing members other than the at least one image bearing member face is substantially a right angle. The apparatus also includes a belt stretching member contacting a transfer-material bearing surface region of the transfer belt other than the first surface plane and the second surface plane, for stretching the transfer-material bearing belt so that a contact portion between the belt stretching member and the transfer-material bearing belt approaches the first surface plane and the second surface plane.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

Preferred embodiments of the present invention will now be described with reference to the drawings.

First Embodiment

Figure 1:
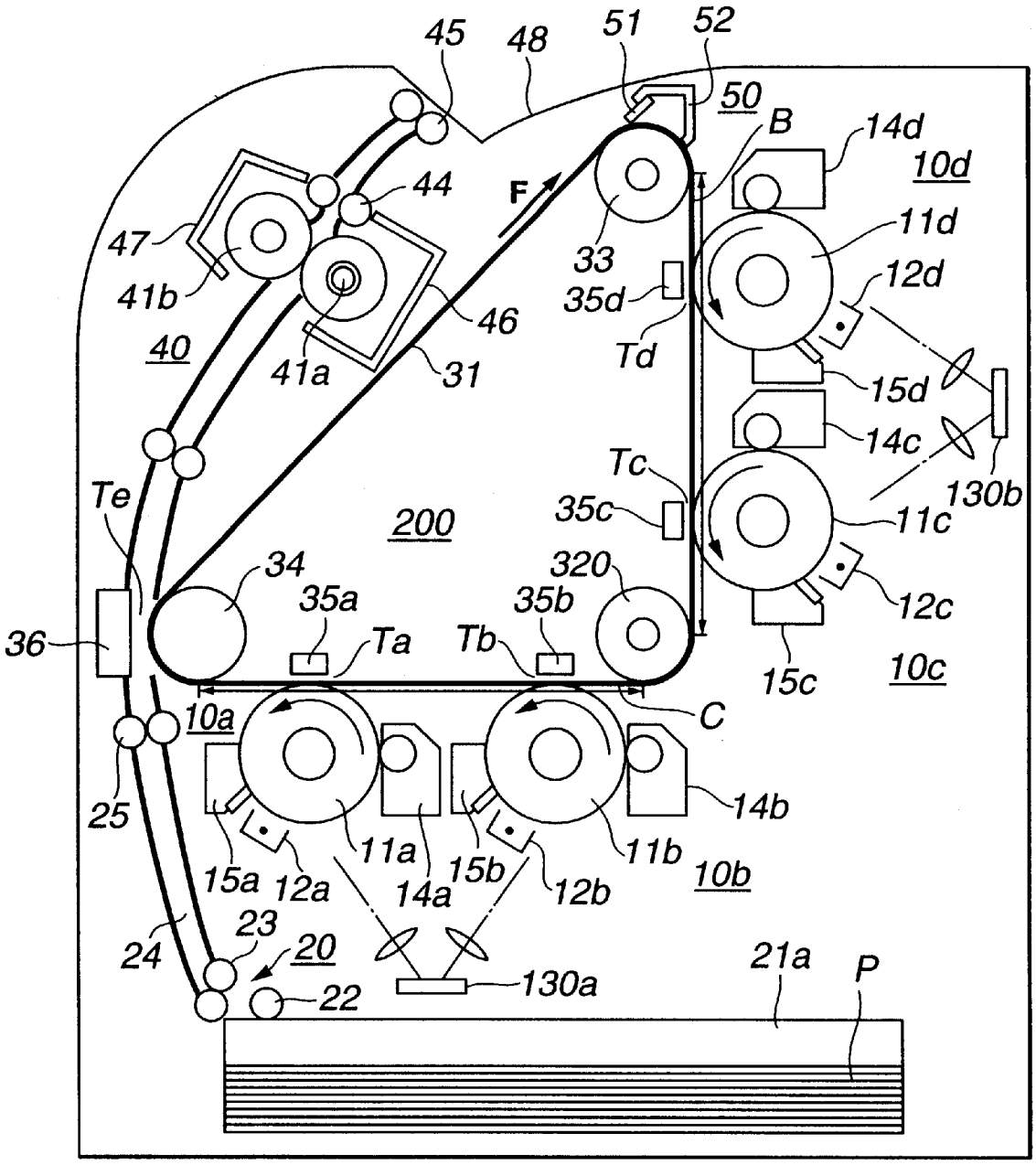
FIG. 1 is a cross-sectional view illustrating an image forming apparatus according to a first embodiment of the present invention.
Figure 7:
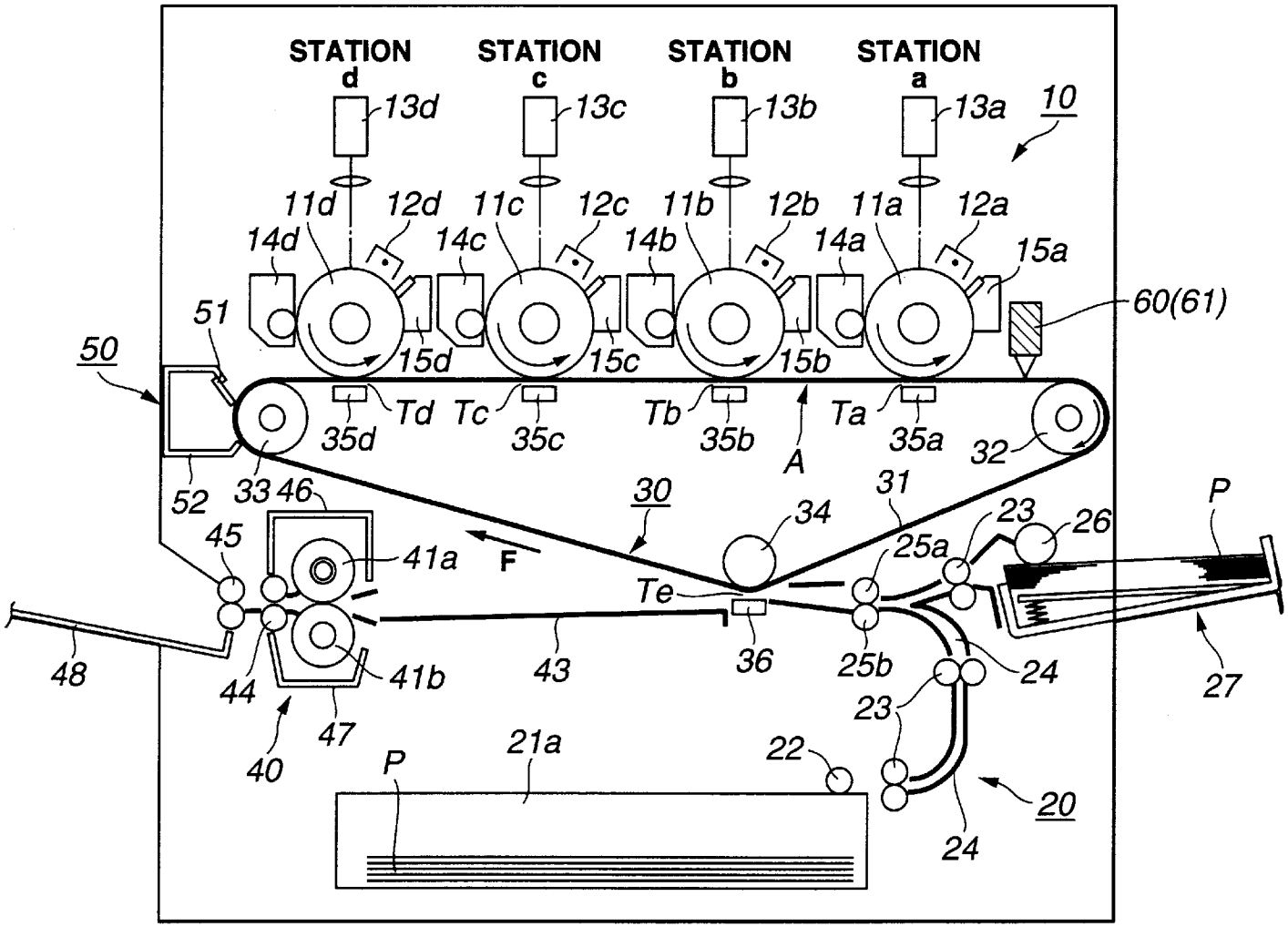
FIG.7 (PRIOR ART)
FIG. 7 is a cross-sectional view illustrating a conventional image forming apparatus.

FIG. 1 is a schematic cross-sectional view illustrating an image forming apparatus according to a first embodiment of the present invention. In FIG. 1, components having the same functions as corresponding components in the conventional apparatus shown in FIG. 7 are indicated by the same reference numerals, and further description thereof will be omitted.

The image forming apparatus of the first embodiment includes a substantially triangular intermediate transfer unit 200. The intermediate transfer unit 200 includes an intermediate transfer belt 31, serving as an intermediate transfer member, for example, made of polyethylene terephthalate, polyvinylidene fluoride or the like. The intermediate transfer belt 31 is rotated around a tension roller 33, urged by urging means, such as a spring or the like, for providing an appropriate tension to the intermediate transfer belt 31, a driving roller 320 for transmitting a driving force to the intermediate transfer belt 31 and bending a primary transfer surface, and a driven roller 34 facing a secondary transfer region Te via the intermediate transfer belt 31. A substantially vertical primary transfer plane B is formed between the tension roller 33 and the driving roller 320, and a substantially horizontal primary transfer plane C is formed between the driving roller 320 and the driven roller 34. The driving roller 320 comprises a metal roller, whose surface is coated with urethane-rubber or chloroprene-rubber having a thickness of a few mm in order to prevent slip. The driving roller 320 is driven by driving means, such as a pulse motor or the like.

Primary transfer devices 35*a*–35*d* are provided at primary transfer regions Ta–Td where photosensitive drums 11*a*–11*d* face the intermediate transfer belt 31, respectively, at positions behind the intermediate transfer belt 31. A secondary transfer device 36 is provided so as to face the driven roller 34 to form a secondary transfer region Te. A cleaning device 50 for cleaning the image forming surface of the intermediate transfer belt 31 is provided on the image transfer belt 31 at a portion downstream from the secondary transfer region Te. The cleaning device 50 includes a cleaner blade 51 made of polyurethane rubber or the like, and a waste-toner box 52 for accommodating a waste toner.

In the first embodiment, since two image forming units 10*a* and 10*b*, serving as image forming means, and two image forming units 10*c* and 10*d* are arranged in series along the surface planes C and B of the intermediate transfer belt 31, respectively, only two exposure units 130*a* and 130*b* commonly used for the image forming units 10*a* and 10*b*, and 10*c* and 10*d*, respectively, suffice.

By arranging the surface planes B and C of the intermediate transfer belt 31 to be substantially orthogonal to each other, a configuration in which the area for providing the intermediate transfer unit 200 is minimized, and the area of contact between the intermediate transfer belt 31 and the driving roller 320 is also minimized (about ¼ of the circumferential surface of the driving roller 320) is achieved. It is thereby possible to minimize the amount of shift of the intermediate transfer belt 31 due to excessive contact with the driving roller 320, and allow compatibility between reduction in the size of the apparatus and prevention of deviation of the image.

As described above, in an image forming apparatus including the intermediate transfer unit 200, it is possible to realize a small image forming apparatus whose volume is reduced compared with the conventional image forming apparatus. In addition to the effect of reducing the production cost by reducing the size of the apparatus, the effect of reducing the production cost by providing only two exposure units can also be provided.

By using the image forming unit 10*a* as a developing unit for transferring a black toner which is most frequently used, the image forming unit 10*a* can be disposed at a position furthest downstream in a direction of conveying the transfer belt 31; that is, a position near the secondary transfer region Te. Hence, the distance between the image forming unit 10*a* for a black image and the secondary transfer region Te becomes shorter than in the conventional image forming apparatus (shown in FIG. 7). As a result, the first printing time in black monochromatic printing can be reduced.

In the conventional image forming apparatus, as shown in FIG. 7, portions of the cleaning device 50, the intermediate transfer unit 30 and the developing unit 10 which are positioned above the fixing unit 40 are directly influenced by the heat and vapor generated from the fixing unit 40. In the first embodiment, however, as shown in FIG. 1, by providing a fixing unit 40 at a position sufficiently separated from the intermediate transfer unit 200 and the image forming units 10*a*–10*d*, such that at a side portion of and below the cleaning device 50, and at a side portion of and above the intermediate transfer unit 200 and the image forming units 10*a*–10*d*, the cleaning device 50, the intermediate transfer unit 200 and the image forming units 10*a*–10*d* are not influenced by the heat and vapor generated from the fixing unit 40. As a result, the problems of temperature rise within the image forming apparatus and degradation of the image forming units 10*a*–10*d* and the intermediate transfer belt 31 are solved.

Second Embodiment

Figure 2:
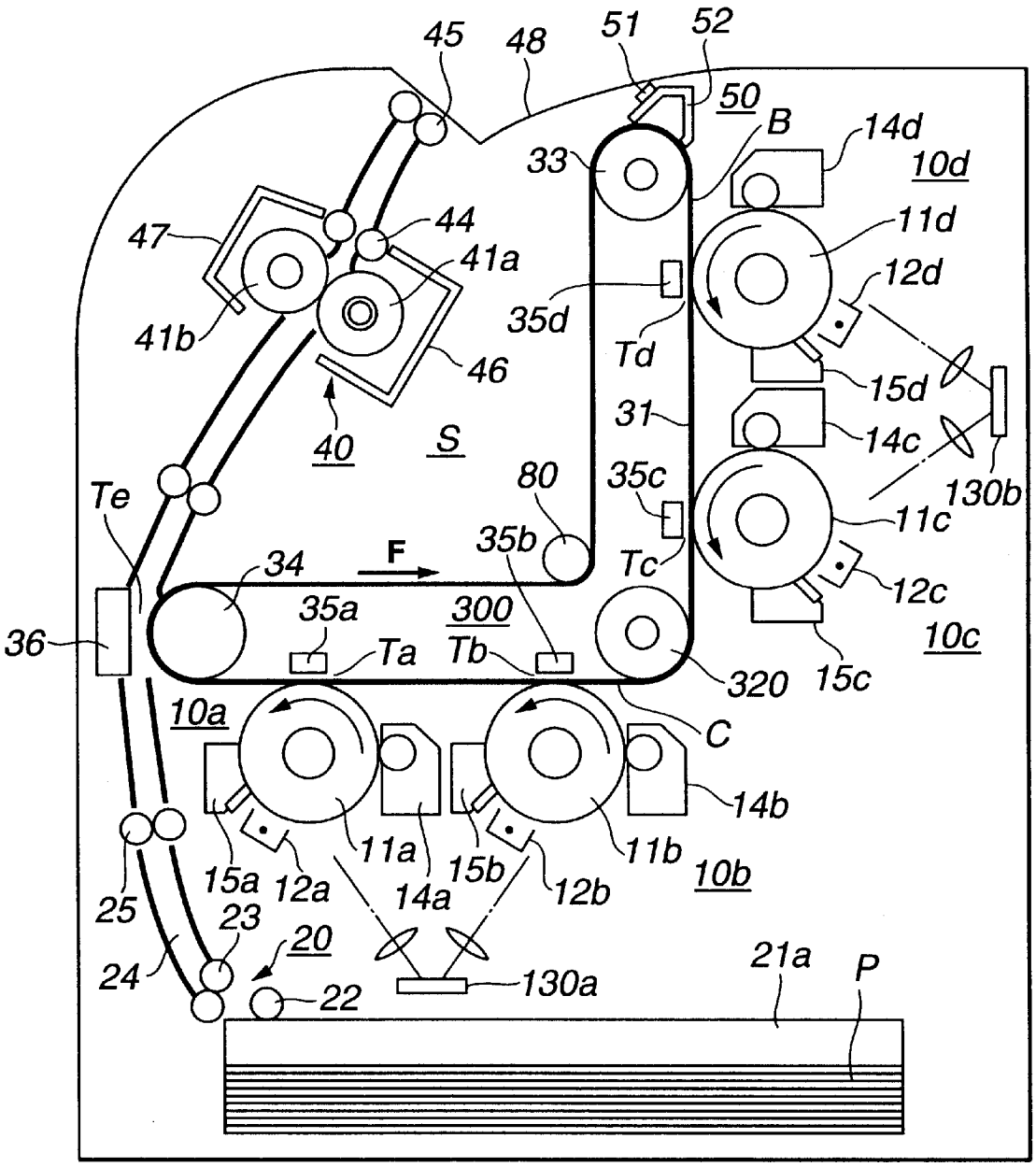
FIG. 2 is a cross-sectional view illustrating an image forming apparatus according to a second embodiment of the present invention.

FIG. 2 is a schematic cross-sectional view illustrating an image forming apparatus according to a second embodiment of the present invention. In FIG. 2, components having the same functions as corresponding components in the conventional apparatus shown in FIG. 7 are indicated by the same reference numerals, and further description thereof will be omitted.

The image forming apparatus of the second embodiment includes an intermediate transfer unit 300 in which an intermediate belt 31 is stretched in the shape of inverse L. The intermediate transfer unit 300 includes the intermediate transfer belt 31 made of polyethylene terephthalate, polyvinylidene fluoride or the like. The intermediate transfer belt 31 is rotated around a tension roller 33, urged by urging means, such as a spring or the like, for providing an appropriate tension to the intermediate transfer belt 31, a driving roller 320 for driving the intermediate transfer belt 31 and bending a primary transfer surface, a driven roller 34 facing a secondary transfer region Te via the intermediate transfer belt 31, and an external roller 80 provided at a position outside of the intermediate transfer belt 31 between the secondary transfer region Te and an image transfer region Td. A substantially vertical primary transfer plane B is formed between the tension roller 33 and the driving roller 320, and a substantially horizontal primary transfer plane C is formed between the driving roller 320 and the driven roller 34. The driving roller 320 comprises a metal roller, whose surface is coated with urethane-rubber or chloroprene-rubber having a thickness of a few mm in order to prevent slip. The driving roller 320 is driven by driving means, such as a pulse motor or the like.

Primary transfer devices 35*a*–35*d* are provided at primary transfer regions Ta–Td where photosensitive drums 11*a*–11*d* face the intermediate transfer belt 31, respectively, at positions behind the intermediate transfer belt 31. A secondary transfer device 36 is provided so as to face the driven roller 34 to form a secondary transfer region Te. A cleaning device 50 for cleaning the image forming surface of the intermediate transfer belt 31 is provided on the image transfer belt 31 at a portion downstream from the secondary transfer region Te. The cleaning device 50 includes a cleaner blade 51 made of polyurethane rubber or the like, and a waste-toner box 52 for accommodating a waste toner.

As shown in FIG. 2, a fixing unit 40 is provided within a space S obtained by forming the intermediate transfer unit 300 in the shape of inverse L.

In the second embodiment, since two image forming units 10*a* and 10*b* and two image forming units 10*c* and 10*d* are arranged in series along the surfaces C and B of the intermediate transfer belt 31, respectively, only two exposure units 130*a* and 130*b* commonly used for the image forming units 10*a* and 10*b*, and 10*c* and 10*d*, respectively, suffice.

As described above, in the image forming apparatus including the intermediate transfer unit 300 having the shape of inverse L, it is possible to reduce the volume of the apparatus compared with the conventional image forming apparatus and realize an image forming apparatus which is further smaller than the apparatus of the first embodiment. In addition to the effect of reducing the production cost by reducing the size of the apparatus, the effect of reducing the production cost by providing only two exposure units can also be provided.

In the conventional image forming apparatus, as shown in FIG. 7, portions of the cleaning device 50, the intermediate transfer unit 30 and the developing unit 10 which are positioned above the fixing unit 40 are directly influenced by the heat and vapor generated from the fixing unit 40. In the second embodiment, however, as shown in FIG. 2, by providing a fixing unit 40 at a position sufficiently separated from the intermediate transfer unit 300 and the image forming units 10*a*–10*d*, such that at a side portion of and below the cleaning device 50, and at a side portion of and above the intermediate transfer unit 300 and the image forming units 10*a*–10*d*, the cleaning device 50, the intermediate transfer unit 300 and the image forming units 10*a*–10*d* are not influenced by the heat and vapor generated from the fixing unit 40. As a result, the problems of temperature rise within the image forming apparatus and degradation of the image forming units 10*a*–10*d* and the intermediate transfer belt 31 are solved.

By using the image forming unit 10*a* as a unit for a black image which is most frequently used, the image forming unit 10*a* can be disposed at a position furthest downstream in a direction of conveying the transfer belt 31; that is, a position near the secondary transfer region Te. Hence, the distance between a transfer position for a black image and the secondary transfer region Te becomes shorter than in the conventional image forming apparatus (shown in FIG. 7). As a result, the first printing time in black monochromatic printing can be reduced.

Third Embodiment

Next, a third embodiment of the present invention will be described.

Figure 3:
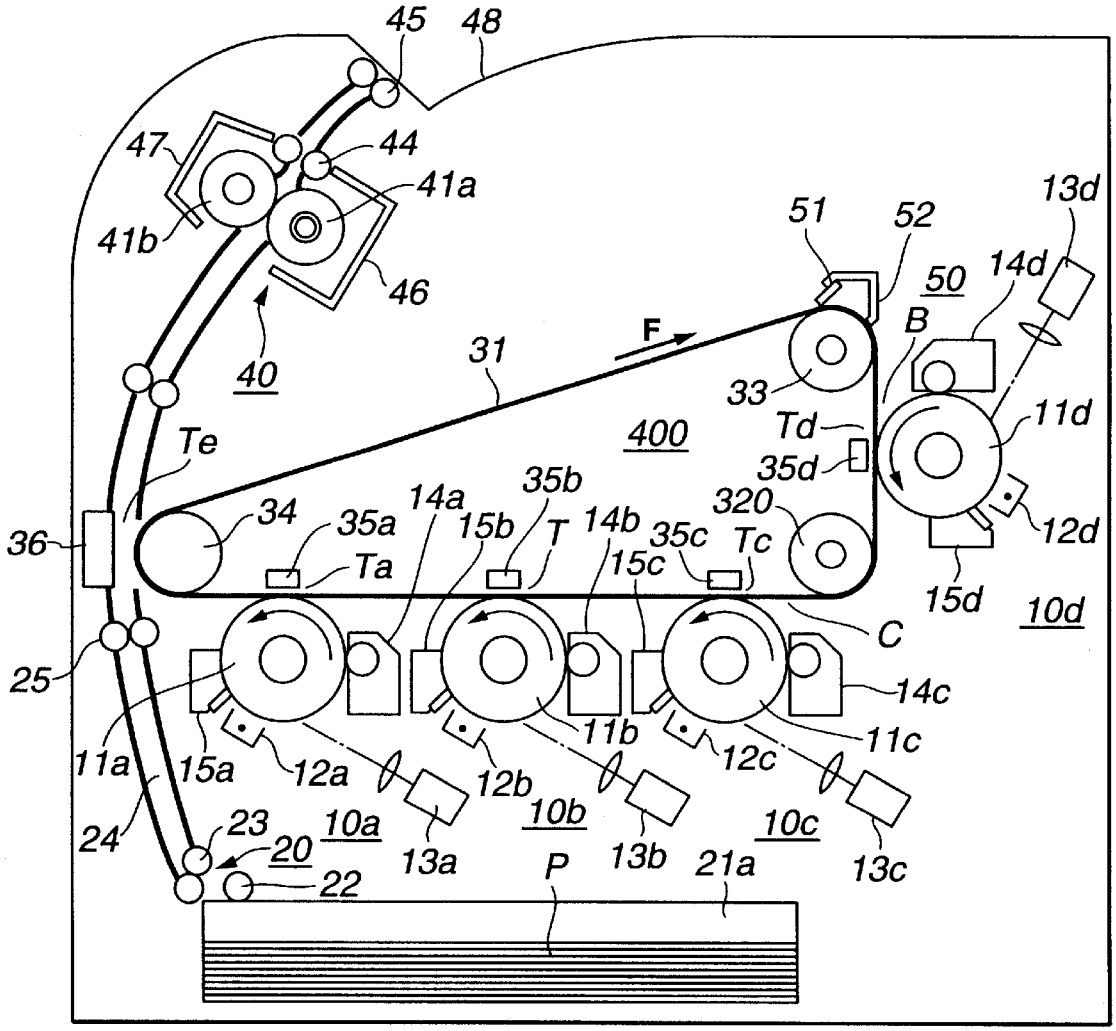
FIG. 3 is a cross-sectional view illustrating an image forming apparatus according to a third embodiment of the present invention.

FIG. 3 is a cross-sectional view illustrating a principal portion of an image forming apparatus according to the third embodiment.

In the first and second embodiments, two pairs of image forming units are separately arranged on the primary transfer surface. In the third embodiment, however, three image forming units 10*a*–10*c* and an image forming unit 10*d* are separately arranged on a primary transfer surface. In the third embodiment, also, it is possible to reduce the volume of the apparatus compared with the conventional image forming apparatus, and realize a small image forming apparatus.

As shown in FIG. 3, by providing a fixing unit 40 at a position sufficiently separated from a cleaning device 50, an intermediate transfer unit 400 and image forming units 10*a*–10*d*, the cleaning device 50, the intermediate transfer unit 400 and the image forming units 10*a*–10*d* are not influenced by the heat and vapor generated from the fixing unit 40. As a result, the problems of temperature rise within the image forming apparatus and degradation of the image forming units 10*a*–10*d* and an intermediate transfer belt 31 are solved.

By using the image forming unit 10*a* as a unit for a black image which is most frequently used, the image forming unit 10*a* can be disposed at a position furthest downstream in a direction of conveying the transfer belt 31; that is, a position near a secondary transfer region Te. Hence, the distance between a transfer position for a black image and the secondary transfer region Te becomes shorter than in the conventional image forming apparatus (shown in FIG. 7). As a result, the first printing time in black monochromatic printing can be reduced.

Fourth Embodiment

Although in the above-described embodiments, the cases of performing secondary transfer of a toner image transferred to the intermediate transfer belt have been illustrated, the present invention may also be applied to an image forming apparatus in which a sheet is conveyed by a belt in a state of being electrostatically attracted thereon, and a color image is formed by sequentially transferring toner images onto the sheet from a plurality of image bearing members, and the same effects as described above can be obtained.

Figure 4:
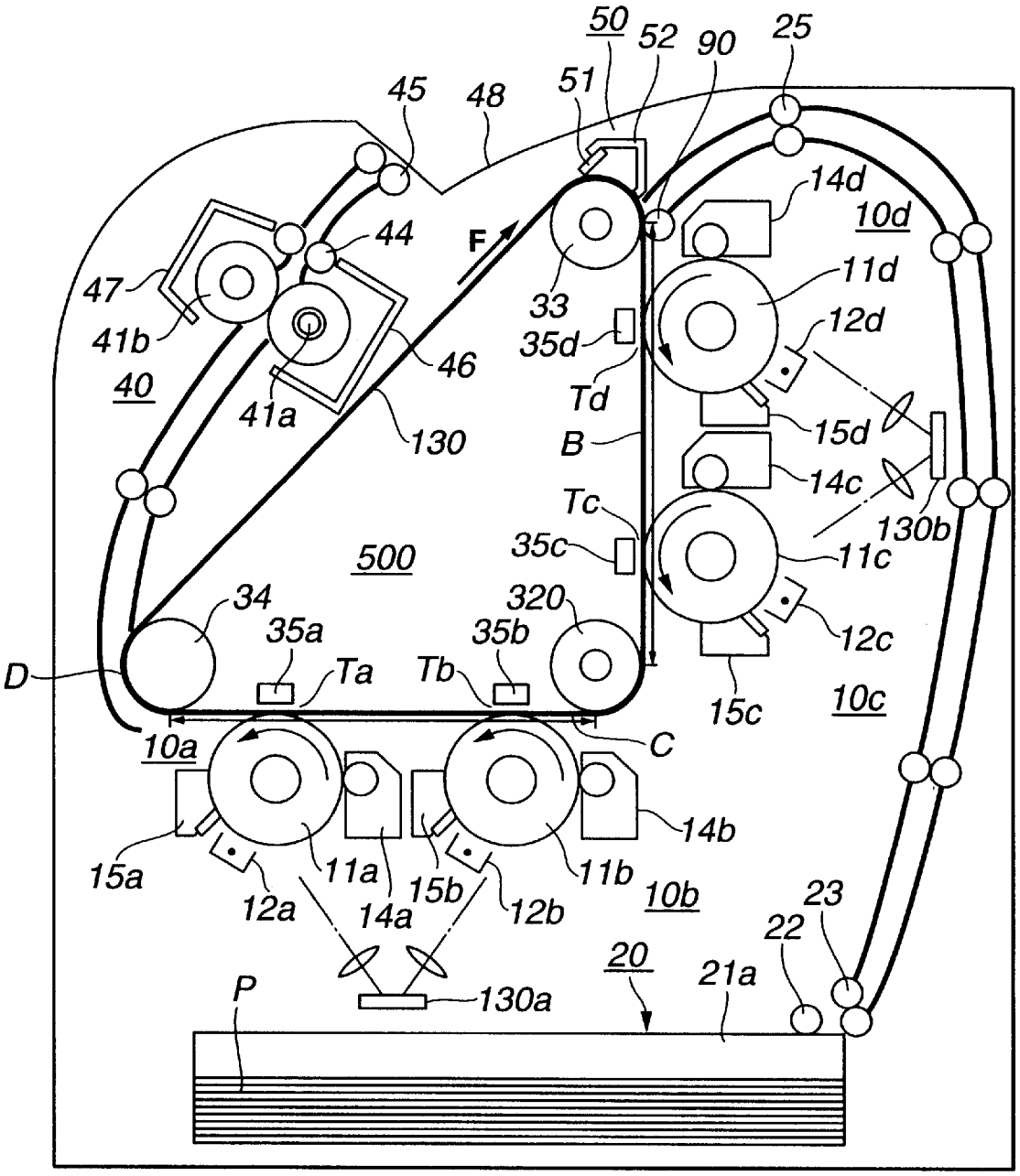
FIG. 4 is a cross-sectional view illustrating an image forming apparatus according to a fourth embodiment of the present invention.

FIG. 4 is a cross-sectional view illustrating an image forming apparatus according to a fourth embodiment of the present invention. The arrangement of image forming means and a transfer belt is the same as in the first embodiment. Components having the same configurations and similar functions as those in the first embodiment are indicated by the same reference numerals.

A recording material (transfer material) P fed from a sheet feeding cassette 20 by a pickup roller 22 is conveyed along a conveying path at the right in FIG. 4 via a pair of rollers 23 to registration rollers 25. The recording material P is conveyed from the registration rollers 25 by adjusting a timing with a corresponding one of image forming units 10*a*–10*d*. The conveyed recording material P is electrostatically attracted onto a transfer belt 130, serving as a transfer-material bearing member, by means of attraction means 90, and is conveyed in the direction of an arrow F together with the transfer belt 130. Images formed by the image forming units 10*d*, 10*c*, 10*b* and 10*a* are sequentially transferred onto the conveyed recording material P by transfer means 35*d*, 35*c*, 35*b* and 35*a*, respectively, to form a (superposed) color image. The recording material P after image transfer is separated from the transfer belt 130 at a point D shown in FIG. 4, and is conveyed along a conveying path to a fixing unit 40. In the fourth embodiment, a case of using a curvature separation method in which the recording material P is separated along the curvature of a roller 34 utilizing the stiffness of the recording material P is illustrated. However, charge separation/removing means, a separation pawl or the like may also be used as separation means.

As described above, in an image forming apparatus using a transfer-material bearing member, by providing the configuration of the fourth embodiment, it also is possible to reduce the size of the overall apparatus, and solve problems of temperature rise within the image forming apparatus, degradation of the image forming units 10*a*–10*d* and the transfer belt 130, and the like.

Fifth Embodiment

Figure 5:
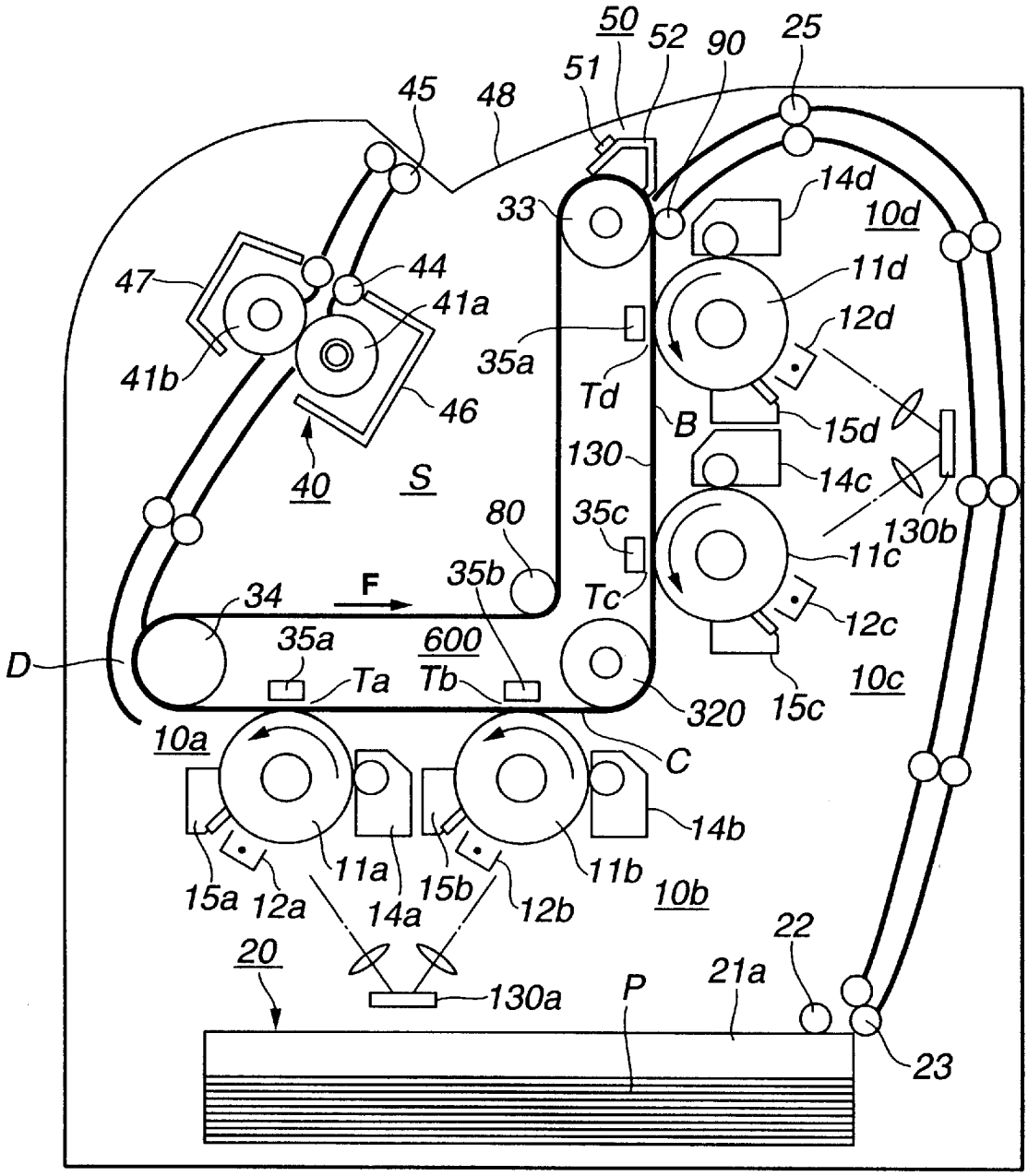
FIG. 5 is a cross-sectional view illustrating an image forming apparatus according to a fifth embodiment of the present invention.

FIG. 5 is a cross-sectional view illustrating an image forming apparatus according to a fifth embodiment of the present invention. The arrangement of image forming units and a transfer belt is the same as in the second embodiment. Components having the same configurations and similar functions as those in the second embodiment are indicated by the same reference numerals.

In the configuration of the fifth embodiment, it also is possible to reduce the size of the overall apparatus, and solve problems of temperature rise within the image forming apparatus, degradation of the image forming units and the transfer belt, and the like.

Sixth Embodiment

Figure 6:
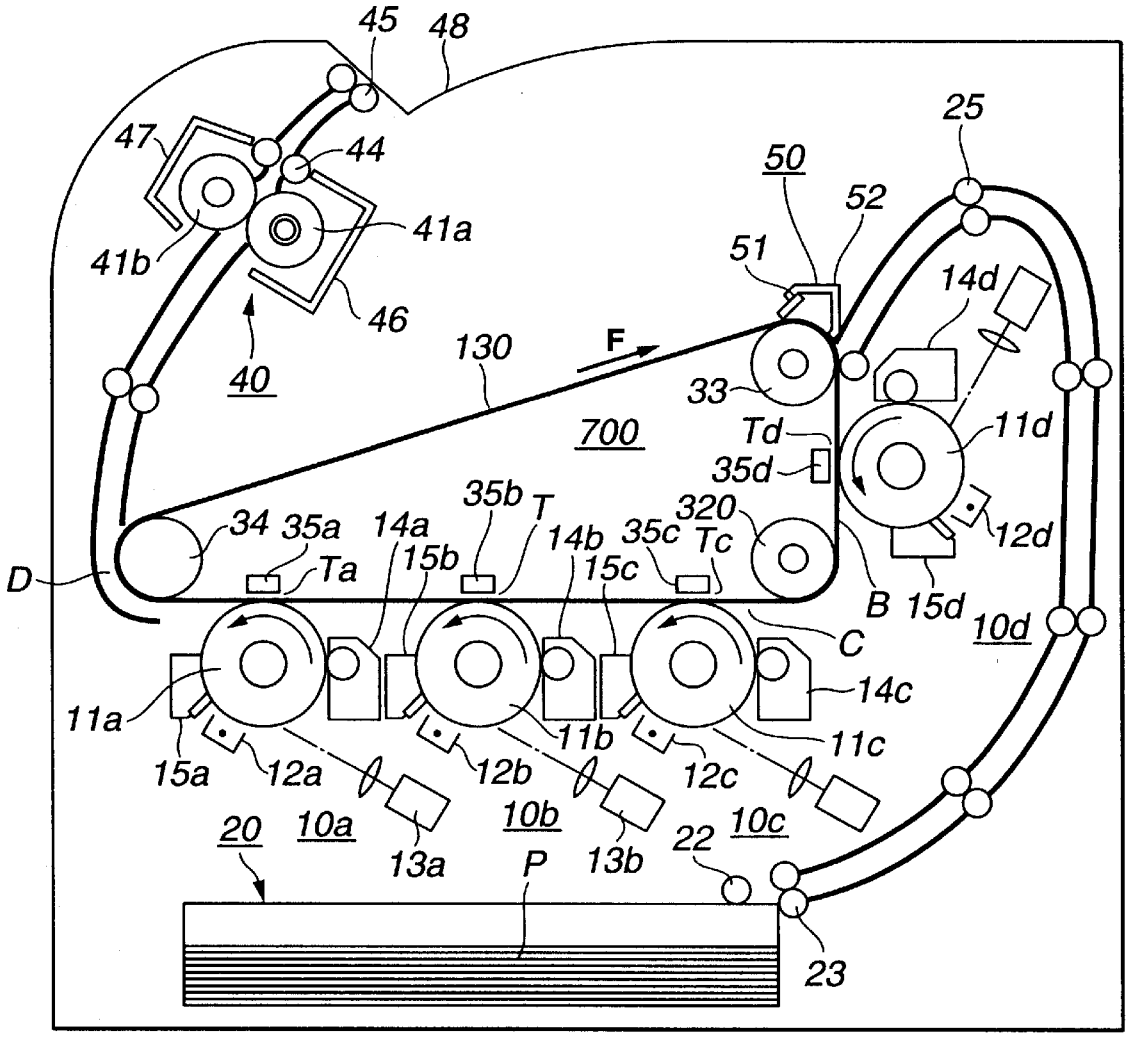
FIG. 6 is a cross-sectional view illustrating an image forming apparatus according to a sixth embodiment of the present invention.

FIG. 6 is a cross-sectional view illustrating an image forming apparatus according to a sixth embodiment of the present invention. The arrangement of image forming means and a transfer belt is the same as in the third embodiment. Components having the same configurations and similar functions as those in the third embodiment are indicated by the same reference numerals.

In the configuration of the sixth embodiment, it also is possible to reduce the size of the overall apparatus, and solve problems of temperature rise within the image forming apparatus, degradation of the image forming unit and the transfer belt, and the like.

The individual components shown in outline in the drawings are all well known in the image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

a plurality of image bearing members, each for bearing an image;

a transfer belt onto which images borne on each of said plurality of image bearing members are transferred; and transfer means for transferring an image on said transfer belt onto a transfer material, wherein when images borne on said plurality of image bearing members are sequentially transferred onto said transfer belt to form superposed images, the superposed images simultaneously are transferred onto the transfer material, and wherein an angle made by a first surface plane of said transfer belt which at least one of said plurality of image bearing members faces and a second surface plane of said transfer belt which image bearing members other than said at least one image bearing member face is substantially a right angle.

2. An image forming apparatus according to claim 1, further comprising a roller member that contacts a surface of said transfer belt opposite a surface facing said plurality of image bearing members, between the first surface plane and the second surface plane of said transfer belt, wherein said transfer belt bends at a portion contacting said roller member.

3. An image forming apparatus according to claim 2, wherein said roller member comprises a driving roller that drives said transfer belt.

4. An image forming apparatus according to claim 1, wherein said transfer belt is stretched around at least three roller members, wherein the first surface plane is present between a first roller member and a second roller member, and wherein the second surface plane is present between the second roller member and a third roller member.

5. An image forming apparatus according to claim 4, wherein said second roller member comprises a driving roller that drives said transfer belt.

6. An image forming apparatus according to claim 4, wherein transfer of an image from said transfer belt onto a transfer material is performed at a region where said transfer belt is stretched around said third roller member.

7. An image forming apparatus according to claim 1, further comprising fixing means for fixing an image transferred onto the transfer material, wherein said fixing means is disposed near a surface region other than the first surface plane and the second surface plane of said transfer belt.

8. An image forming apparatus according to claim 7, wherein said transfer belt is stretched around at least three roller members, wherein the first surface plane is present between a first roller member and a second roller member, wherein the second surface plane is present between the second roller member and a third roller member, and wherein said fixing means is disposed near a surface region of said transfer belt present between said first roller member and said third roller member.

9. An image forming apparatus according to claim 1, wherein a black image is formed on one of said plurality of image bearing members at a furthest downstream portion in a direction of conveying said transfer belt.

10. An image forming apparatus according to claim 1, further comprising first common exposure means for performing exposure for all image bearing members among said plurality of image bearing members facing the first surface plane, and second common exposure means for performing exposure for all image bearing members among said plurality of image bearing members facing the second surface plane.

11. An image forming apparatus comprising:

a plurality of image bearing members, each for bearing an image;

a transfer belt onto which images borne on each of the image bearing members are transferred; and transfer means for transferring an image on said transfer belt onto a transfer material, wherein when images borne on said plurality of image bearing members are sequentially transferred onto said transfer belt to form superposed images, the superposed images simultaneously are transferred onto the transfer material, and wherein an angle made by a first surface plane of said transfer belt which at least one of said plurality of image bearing members face and a second surface plane of said transfer belt which image bearing members other than said at least one image bearing member face is substantially a right angle; and a belt stretching member contacting an image transfer surface of said transfer belt at a surface region other than the first surface plane and the second surface plane, that stretches said transfer belt so that a contact portion between said belt stretching member and said transfer belt approaches the first surface plane and the second surface plane.

12. An image forming apparatus according to claim 11, further comprising a roller member that contacts a surface of said transfer belt opposite the image transfer surface facing said plurality of image bearing members, between the first surface plane and the second surface plane of said transfer belt, wherein said transfer belt bends at a portion contacting said roller member.

13. An image forming apparatus according to claim 12, wherein said roller member comprises a driving roller that drives said transfer belt.

14. An image forming apparatus according to claim 11, wherein said transfer belt is stretched around at least three roller members, wherein the first surface plane is present between a first roller member and a second roller member, and wherein the second surface plane is present between the second roller member and a third roller member.

15. An image forming apparatus according to claim 14, wherein said second roller member comprises a driving roller that drives said transfer belt.

16. An image forming apparatus according to claim 14, wherein transfer of an image from said transfer belt onto a transfer material is performed at a region where said transfer belt is stretched around said third roller member.

17. An image forming apparatus according to claim 11, further comprising fixing means for fixing an image transferred onto a transfer material, wherein said fixing means is disposed near a surface other than the first surface plane and the second surface plane of said transfer belt.

18. An image forming apparatus according to claim 17, wherein said transfer belt is stretched around at least three roller members, wherein the first surface plane is present between a first roller member and a second roller member, wherein the second surface plane is present between the second roller member and a third roller member, and wherein said belt stretching member contacts said transfer belt stretched between said first roller member and said third roller member.

19. An image forming apparatus according to claim 11, wherein a black image is formed on one of said plurality of image bearing members at a furthest downstream portion in a direction of conveying said transfer belt.

20. An image forming apparatus according to claim 11, further comprising first common exposure means for performing exposure for all image bearing members among said plurality of image bearing members facing the first surface plane, and second common exposure means for performing exposure for all image bearing members among said plurality of image bearing members facing the second surface plane.

21. An image forming apparatus comprising:

a plurality of image bearing members, each for bearing an image;

a transfer-material bearing belt for bearing and conveying a transfer material; and transfer means for sequentially transferring respective images borne on said plurality of image bearing members onto a transfer material borne and conveyed on said transfer-material bearing member, so as to form superposed images, wherein an angle made by a first surface plane of said transfer-material bearing belt which at least one of said plurality of image bearing members faces and a second surface plane of said transfer-material bearing member which image bearing members other than said at least one image bearing member face is substantially a right angle.

22. An image forming apparatus according to claim 21, further comprising a roller member that contacts a surface region of said transfer-material bearing belt opposite a surface facing said plurality of image bearing members, between the first surface plane and the second surface plane of said transfer-material bearing belt, wherein said transfer-material bearing belt bends at a portion contacting said roller member.

23. An image forming apparatus according to claim 22, wherein said roller member comprises a driving roller that drives said transfer-material bearing belt.

24. An image forming apparatus according to claim 21, wherein said transfer-material bearing belt is stretched around at least three roller members, wherein the first surface plane is present between a first roller member and a second roller member, and wherein the second surface plane is present between the second roller member and a third roller member.

25. An image forming apparatus according to claim 24, wherein said second roller member comprises a driving roller that drives said transfer-material bearing belt.

26. An image forming apparatus according to claim 24, wherein separation of the transfer material from said transfer-material bearing belt is performed near a separation region where said transfer-material bearing belt is stretched around said third roller member.

27. An image forming apparatus according to claim 21, further comprising fixing means for fixing an image transferred onto a transfer material, wherein said fixing means is disposed near a surface region other than the first surface plane and the second surface plane of said transfer-material bearing belt.

28. An image forming apparatus according to claim 27, wherein said transfer-material bearing belt is stretched around at least three roller members, wherein the first surface plane is present between a first roller member and a second roller member, wherein the second surface plane is present between the second roller member and a third roller member, and wherein said fixing means is disposed near a surface region of said transfer-material bearing belt present between said first roller member and said third roller member.

29. An image forming apparatus according to claim 21, wherein a black image is formed on one of said plurality of image bearing members at a furthest downstream portion in a direction of conveying said transfer-material bearing belt.

30. An image forming apparatus according to claim 21, further comprising first common exposure means for performing exposure for all image bearing members among said plurality of image bearing members facing the first surface plane, and second common exposure means for performing exposure for all image bearing members among said plurality of image bearing members facing the second surface plane.

31. An image forming apparatus comprising:

a plurality of image bearing members, each for bearing an image;

a transfer-material bearing belt for bearing and conveying a transfer material;

transfer means for sequentially transferring respective images borne on said plurality of image bearing members onto a transfer material borne and conveyed on said transfer-material bearing member so as to form superposed images, where an angle made by a first surface plane of said transfer-material bearing belt which at least one of said plurality of image bearing members faces and a second surface plane of said transfer-material bearing member which image bearing members other than said at least one image bearing member face is substantially a right angle; and a belt stretching member contacting a transfer-material bearing surface region of said transfer-material bearing belt other than the first surface plane and the second surface plane, that stretches said transfer-material bearing belt so that a contact portion between said belt stretching member and said transfer-material bearing belt approaches the first surface plane and the second surface plane.

32. An image forming apparatus according to claim 31, further comprising a roller member that contacts a surface of said transfer-material bearing belt opposite the transfer-material bearing surface, between the first surface plane and the second surface plane of said transfer-material bearing belt, wherein said transfer-material bearing belt bends at a portion contacting said roller member.

33. An image forming apparatus according to claim 32, wherein said roller member comprises a driving roller that drives said transfer-material bearing belt.

34. An image forming apparatus according to claim 31, wherein said transfer-material bearing belt is stretched around at least three roller members, wherein the first surface plane is present between a first roller member and a second roller member, and wherein the second surface plane is present between the second roller member and a third roller member.

35. An image forming apparatus according to claim 34, wherein said second roller member comprises a driving roller that drives said transfer-material bearing belt.

36. An image forming apparatus according to claim 34, wherein separation of a transfer material from said transfer-material bearing belt is performed near a region where said transfer-material bearing belt is stretched around said third roller member.

37. An image forming apparatus according to claim 31, further comprising fixing means for fixing an image transferred onto a transfer material, wherein said fixing means is disposed near a space outside said transfer-material bearing belt formed by arrangement of said belt stretching member.

38. An image forming apparatus according to claim 37, wherein said transfer-material bearing belt is stretched around at least three roller members, wherein the first surface plane is present between a first roller member and a second roller member, wherein the second surface plane is present between the second roller member and a third roller member, and wherein said belt stretching member contacts said transfer-material bearing belt stretched between said first roller member and said third roller member.

39. An image forming apparatus according to claim 31, wherein a black image is formed on one of said plurality of image bearing members at a furthest downstream portion in a direction of conveying said transfer-material bearing belt.

40. An image forming apparatus according to claim 31, further comprising first common exposure means for performing exposure for all image bearing members among said plurality of image bearing members facing the first surface plane, and second common exposure means for performing exposure for all image bearing members among said plurality of image bearing members facing the second surface plane.

* * * * *

UNITED STATES PATENT AND TRADEMARK OFFICE

CERTIFICATE OF CORRECTION

PATENT NO. : 6,539,194 B2
DATED : March 25, 2003
INVENTOR(S) : Atsuteru Oikawa

It is certified that error appears in the above-identified patent and that said Letters Patent is hereby corrected as shown below:

Column 1,
Line 46, “cyan” should read -- cyan, --.

Column 3,
Line 12, “subjected” should read -- subjected to --.

Signed and Sealed this

Eighteenth Day of November, 2003

JAMES E. ROGAN
*Director of the United States Patent and Trademark Office*